United States Patent [19]

Sargeant et al.

[11] Patent Number: 4,834,363

[45] Date of Patent: May 30, 1989

[54] BICYCLE RACING TRAINING APPARATUS

[75] Inventors: Bruce A. Sargeant, Orange; Mark J. Hoffenberg, Niguel; Rob Reasons, Mission Viejo; Robert A. Walpert, Montery Park, all of Calif.

[73] Assignee: Schwinn Bicycle Company, Chicago, Ill.

[21] Appl. No.: 54,749

[22] Filed: May 26, 1987

[51] Int. Cl.[4] ..... A63B 21/00; G09B 9/04

[52] U.S. Cl. ..... 272/73; 434/61

[58] Field of Search ..... 272/73, 72; 434/61; D21/194

[56] References Cited

U.S. PATENT DOCUMENTS

| | | | |
|---|---|---|---|
| 2,784,591 | 3/1957 | Shoor . | |
| 3,486,242 | 12/1969 | Aronson . | |
| 3,511,097 | 5/1970 | Corwin . | |
| 3,526,042 | 9/1970 | Nelson . | |
| 3,643,943 | 2/1972 | Erwin, Jr. et al. . | |
| 3,903,613 | 9/1975 | Bisberg . | |
| 3,940,989 | 3/1976 | Engerstam . | |
| 3,979,113 | 9/1976 | Uhl et al. | 272/73 |
| 4,060,239 | 11/1977 | Pfleiderer et al. . | |
| 4,133,550 | 1/1979 | Brown . | |
| 4,244,021 | 1/1981 | Chiles, III . | |
| 4,261,562 | 4/1981 | Flavell . | |
| 4,358,105 | 11/1982 | Sweeney, Jr. . | |
| 4,441,705 | 4/1984 | Brown | 272/73 |
| 4,477,072 | 10/1984 | DeCloux . | |
| 4,493,485 | 1/1985 | Jones . | |
| 4,519,603 | 5/1985 | DeCloux . | |
| 4,542,897 | 9/1985 | Melton et al. . | |
| 4,556,216 | 12/1985 | Pitkanen . | |
| 4,566,692 | 1/1986 | Brentham . | |
| 4,569,518 | 2/1986 | Fulks . | |
| 4,580,983 | 4/1986 | Cassini et al. . | |
| 4,596,386 | 6/1986 | Sacki . | |
| 4,613,129 | 9/1986 | Schroeder et al. . | |
| 4,674,742 | 6/1987 | Baatz | 272/73 |
| 4,709,917 | 12/1987 | Yang | 272/73 |

FOREIGN PATENT DOCUMENTS

| | | | |
|---|---|---|---|
| 2950605 | 6/1981 | Fed. Rep. of Germany | 272/73 |
| 17570 | of 1899 | United Kingdom | 272/73 |

OTHER PUBLICATIONS

W. Von Dobeln, *A Simple Bicycle Ergometer.*

F. Katch, W. McArdle, G. Peckar and J. Perrine, *Measuring Leg Face-Output Capacity with an Isokinetic Dynamometer-Bicycle Ergometer*, The Research Quarterly, v. 45, No. 1.

M. Firth, *A Sport-Specific Training and Test Device for Racing Cyclists*, Ergonomics, v. 24, No. 7 565-71 (1981).

*Primary Examiner*—Richard J. Apley

*Assistant Examiner*—S. R. Crow

*Attorney, Agent, or Firm*—Knobbe, Martens, Olson et al.

[57] ABSTRACT

In an exercising apparatus for supporting a bicycle, a pivotally mounted member connects to a rear axle of the bike to constrain movement of the axle about the pivot point of the support member. A support roller, located on the horizontally opposite side of the rear axle as is the pivot point, cooperates with the support member to support the rear wheel. A flywheel and variable load means are connected to the roller to simulate the inertia and variable load experienced during the riding of a real bicycle. Preferably, a front fork support connects to the front fork of a bicycle and has an adjustable feature which can change the elevation of the bicycle frame. The front fork support is inclined and connected to the roller and rear axle support member so that when a rider of a bicycle connected to the apparatus leans toward or shifts his weight toward the front fork support, the front fork support bends and the rear tire of the bicycle pivots toward the roller to maintain frictional contact between the tire and roller.

16 Claims, 4 Drawing Sheets

Fig. 1
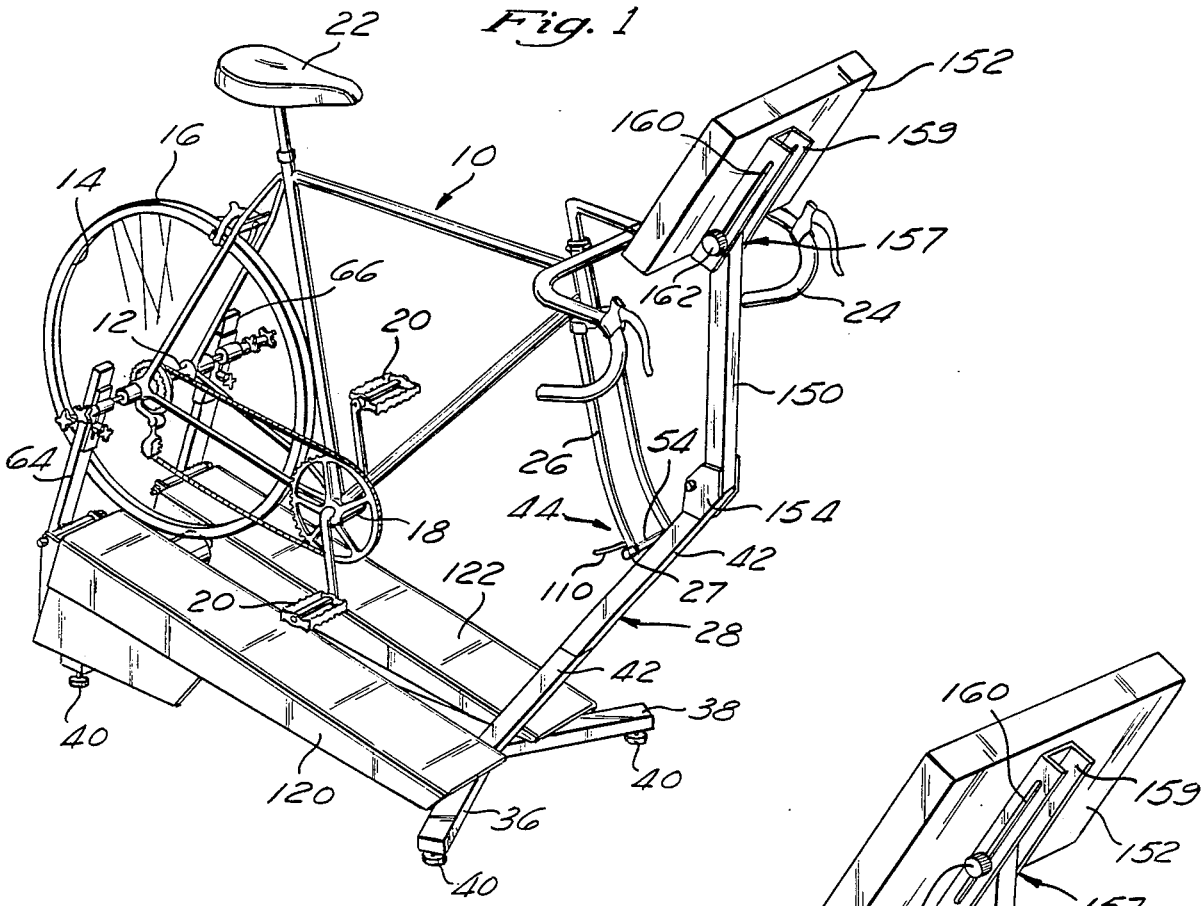
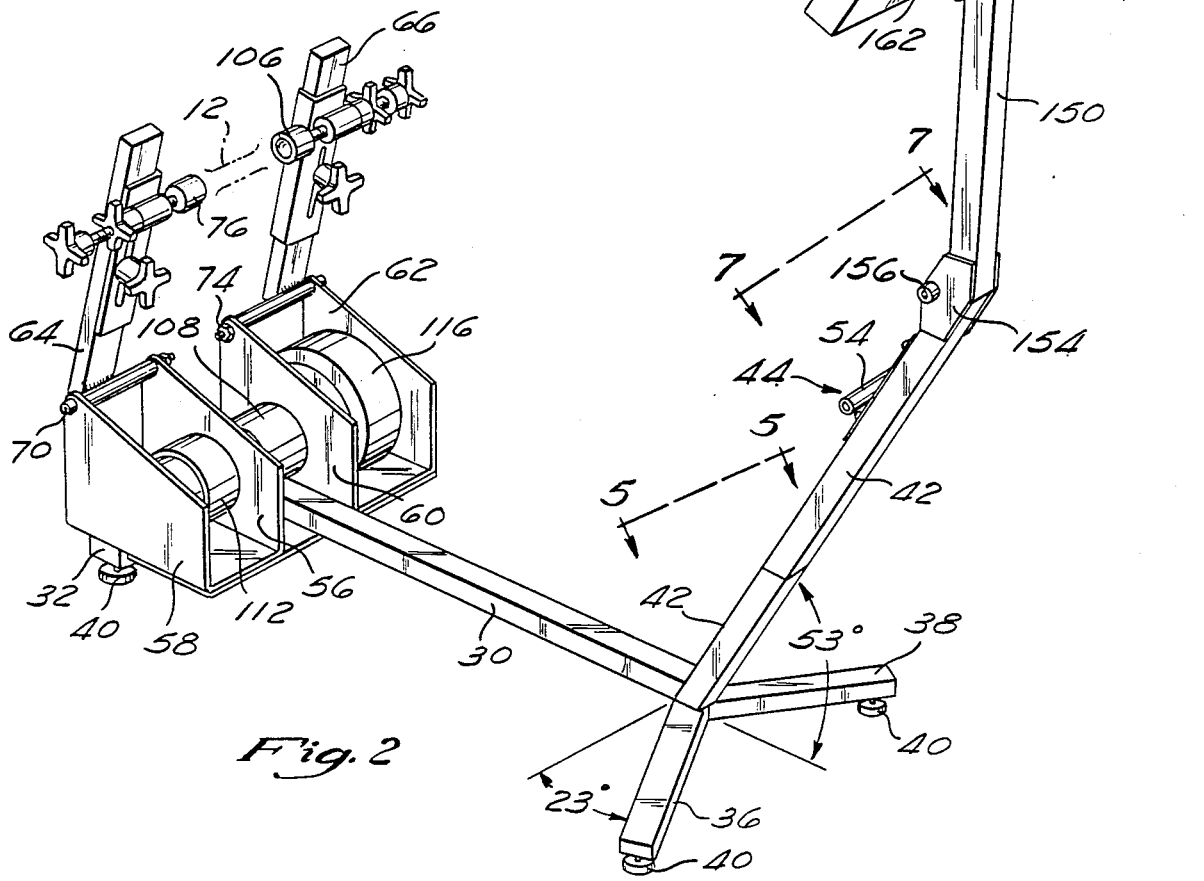
Fig. 2

Fig. 3
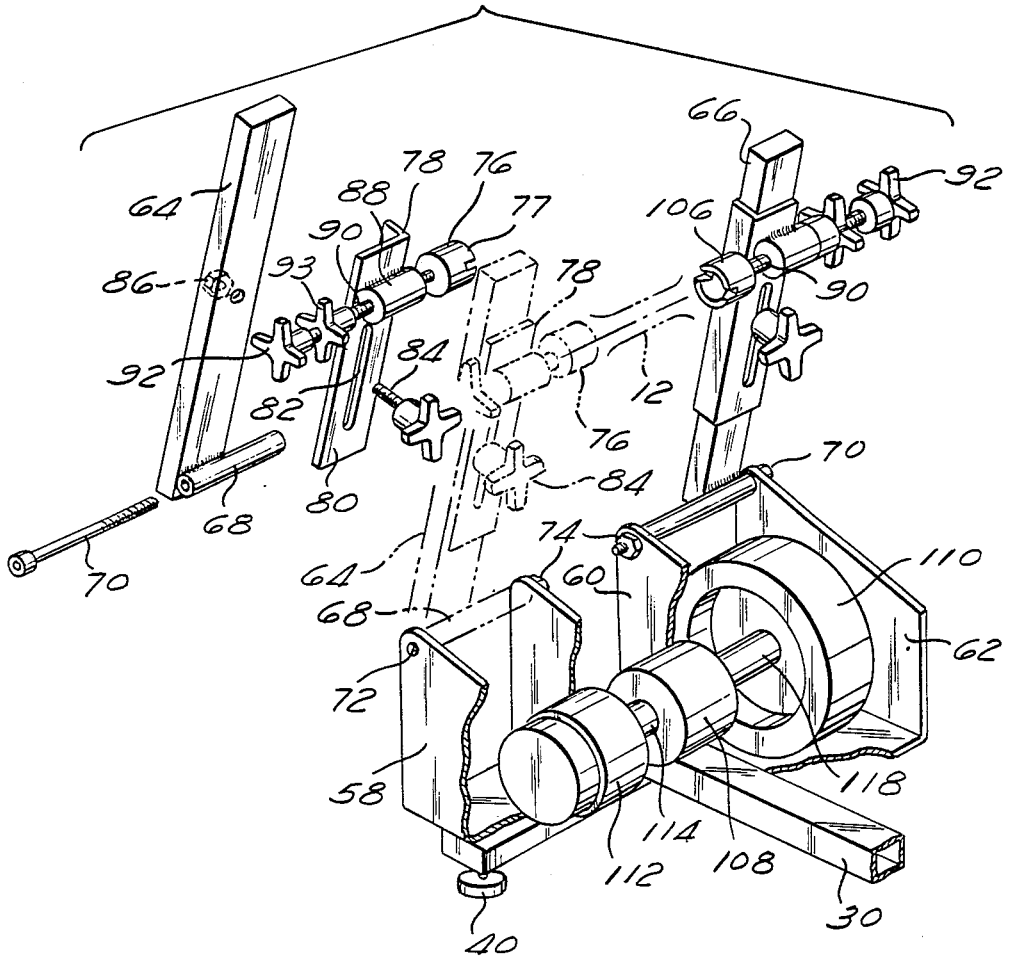
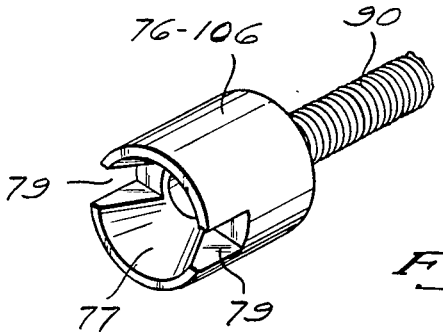
Fig. 4

BICYCLE RACING TRAINING APPARATUS

BACKGROUND OF THE INVENTION

This invention generally relates to a bicycle-type stationary exercise apparatus. The invention is particularly directed to an apparatus for use with a multi-speed bicycle, and is especially suited to train for bicycle races.

FIELD OF THE INVENTION

A number of present-day gymnasiums and exercise clubs have stationary bicycle-type apparatus, whereby a person can pedal a simulated bicycle as a form of exercise. Typically, the bicycle pedals are connected to a frictional device or other load in a way such that the amount of resistance can be adjusted by the person riding the bicycle. Typical examples of this type of stationary bicycle are shown in U.S. Pat. Nos. 4,358,105 (the "Lifecycle") and 4,613,129.

Other exercise devices are adapted so that a conventional bicycle can be mounted to an apparatus which supports the bicycle so that the rear wheel of the bicycle can rotate against a frictional load. These types of devices fall into several general categories, the first of which connects both the front axle and the bottom bracket of the bicycle to a frame in order to support the bicycle. The rear wheel drives against a roller which, in turn, is connected to a loading mechanism. One example of such a device is shown in U.S. Pat. No. 4,441,705 to Brown, in which the rear wheel drives a flywheel and a variable resistance load.

A second type of apparatus used with a conventional bicycle supports the rear wheel, either on a pair of rollers or by a fixed support at the rear axle. For example, U.S. Pat. No. 4,596,386 to Sackl attaches to the rear axle to support the axle at a fixed distance from a pair of rollers. U.S. Pat. No. 3,903,613 to Bisberg supports the front wheel of the bicycle, while the rear wheel rests on a pair of rollers.

Each of the above types of devices has numerous drawbacks for use as an exercise device, and as use for a training device for bicycle racing. The stationary, simulated bicycles, like the "Lifecycle", do not provide a realistic pedal resistance simulating that obtained from riding a real bicycle; they do not adequately simulate inertia, wind resistance, terrain variations, and rolling resistance. Further, this type of stationary bicycle does not realistically simulate the body position or the feel of riding a bicycle, which is not surprising because a standard bicycle frame is not even used.

The devices using a bottom bracket support allow the use of a real bicycle frame, but fail to provide a realistic resistance and ride simulation. This type of equipment usually has one roller contacting the rear wheel.

The devices using a roller or rollers to support the rear wheel have stability and slippage problems. If the roller is behind the rear axle, the roller must be long since the wheel wobbles and moves sideways as it attempts to constantly "fall off" the roller. If the roller is in front of the axle, the wheel stays centered, but does not maintain adequate contact during periods of maximum torque on the rear wheel. In both cases, if a realistic resistance is applied, the rear tire slips on the roller.

For example, during maximum performance periods, the bicycle rider is not on the saddle, but is leaning over the front handlebars and essentially standing on the pedals. As the weight of the rider shifts forward, the force on the rear wheel decreases and the weight on the front wheel increases, causing slipping of the rear wheel. Further, in this position with a bike on a bottom bracket support, the bicycle pivots about the bottom brackets, effectively removing the rear wheel from contact with the supporting roller or rollers. Thus, just when the maximum resistance is needed to prevent slipping at the rear wheel, the rear wheel is at a minimum friction contact with the resistance rollers and slips.

The rear wheel can be preloaded against the support roller(s), but the preload device duly constrains the rear wheel so as to ruin the realism of the ride, and also destroys the realism of the simulated resistance when the rider is sitting in the saddle or bicycle seat, pedalling at a slower speed. Further, the bottom bracket holds the frame too rigid, destroying the realism of the ride as in real life, the frame flexes on the wheels.

The devices which use a pair of support rollers on the rear wheel not only tend to be bulky, but require complicated resistance mechanisms on both rollers in an attempt to achieve an appropriate resistance to the rear wheel rotation. Further, they do not simulate the feel of a real ride and may require a different balance and training to be able to remain upright while riding if the front wheel is also supported on a roller, as in the U.S. Patent to Cassini, et al., No. 4,580,983. For example, if the front fork is fixed or supported, with two rollers on the rear wheel, the rear wheel wobbles and moves while the front is stable. In real life, the rear wheel is stable while the front wheel wobbles or moves. The use of two rollers still does not prevent slipping when the rider comes out of the saddle and leans over the handlebars to exert the maximum force on the pedals. The shift in the rider's weight still causes slippage between the rear wheel and the rollers.

There is thus a need for a device which provides a realistic ride on a bicycle and a realistic resistance, especially so that slippage does not occur when the rider is standing on the pedals to obtain maximum power. Further, there is a need to make such a device portable, especially one which can be used with an individual's own bicycle to provide the maximum realism for training purposes.

SUMMARY OF THE INVENTION

An apparatus is provided which supports the rear wheel and tire of a bicycle so that a shift in the rider's weight causes a rear tire of the bicycle to maintain frictional contact with a roller in order to prevent slippage. The roller is rotatably mounted about a first axis substantially parallel to a rear axle of a bicycle connected to the apparatus. The rear tire is constrained to move in a predetermined manner toward the roller. Preferably, the rear axle of the bicycle is supported on opposite ends of the axle shaft by axle clamps which are adjustably positioned on a rear axle support member. The support members constrains the rear axle to move along a predefined path which extends generally toward the roller. An arcuate path is preferred.

Preferably, the rear axle support means comprises a pair of members, each pivoted at one end about a pivot axis substantially parallel to the rotational axis of the rear wheel and tire. This pivot axis is preferably on the horizontally opposite side of the rear axle of the bicycle, as is the roller's rotational axis. The rear axle clamps can be adjustably positioned to accommodate different sizes of bicycles.

A variable load means, such as a motor, and preferably an alternator, and an inertial means, such as a flywheel, are connected to the roller and are preferably on a common shaft. The variable load and inertial loads exerted on the roller are transferred, via frictional contact with the rear tire, to the bicycle and its rider to simulate the momentum and load experienced during the actual riding of a bicycle. Such loads would include wind resistance, terrain variations, rolling resistance, and the inertia of the bike and rider.

While the roller and support member can be used alone to support the bicycle, it is preferred that the front fork of the bicycle is mounted to a front fork support tube by use of a fork mounting bracket. Preferably the front fork support tube is such that it provides a realistic flexibility to simulate a realistic ride. The fork mounting bracket is positionally adjustable to accommodate different sizes of bicycles. The mounting bracket can flex to simulate real life flexing of the fork and front wheel. By repositioning the mounting bracket relative to the front fork, the elevation of the attached bicycle frame can be changed to tilt slightly upward from a level orientation.

Preferably, the front fork support tube is connected to the same structure that supports the roller and rear axle support mount. Thus, a shift in the weight of the rider off of a bicycle seat toward the front fork will cause the front fork support tube to bend and cause the rear axle support mount to rotate the rear bicycle tire toward the roller so as to prevent slippage between the roller and rear tire.

The front fork support tube also supports a display which is in electronic communication with the roller and alternator so that data, such as the bicycle speed, can be displayed for viewing by the rider.

There is thus advantageously provided a means for supporting a bicycle so as to simulate a realistic ride on that bicycle while preventing slippage of the rear wheel of the bicycle during periods of maximum force on the pedals. The realistic ride includes the feel of the load on the rear tire, as well as the flexibility of the bicycle.

The exercise apparatus can be collapsed into a smaller, portable configuration for portability and for storage. The front fork support tube contains hinges which allow the tube to be folded into an adjacent relationship with the remainder of the apparatus. A releasable hinge adjacent the display unit, and a second releasable hinge located above the fork tube mount bracket, allows the display unit to be folded against the front fork support tube. The hinge at the bottom of the front fork support tube allows that tube, along with the display unit and its support members, to be folded into a position adjacent the roller. The pivot axes, about which the rear axle support members pivot, are positioned so that the rear axle support members can be folded into a position adjacent the roller. Wheels are provided on the end of the frame, adjacent the heavy flywheel and alternator, to allow easy movement of the portable package. There is thus provided a hinging means by which the apparatus can be folded into an adjacent relationship to present a smaller configuration which is much more portable than the operational configuration of the apparatus.

BRIEF DESCRIPTION OF THE DRAWINGS

The present invention can be more readily understood when reference is made to the accompanying drawings in which:

FIG. 1 is a perspective view of this invention with a bicycle connected to it.

FIG. 2 is a perspective view of this invention with the side covering removed.

FIG. 3 is an exploded perspective view of the rear axle clamp, its support, and the motor and flywheel.

FIG. 4 is a perspective view of a rear axle clamp.

DESCRIPTION OF THE PREFERRED EMBODIMENT

Figure 5:
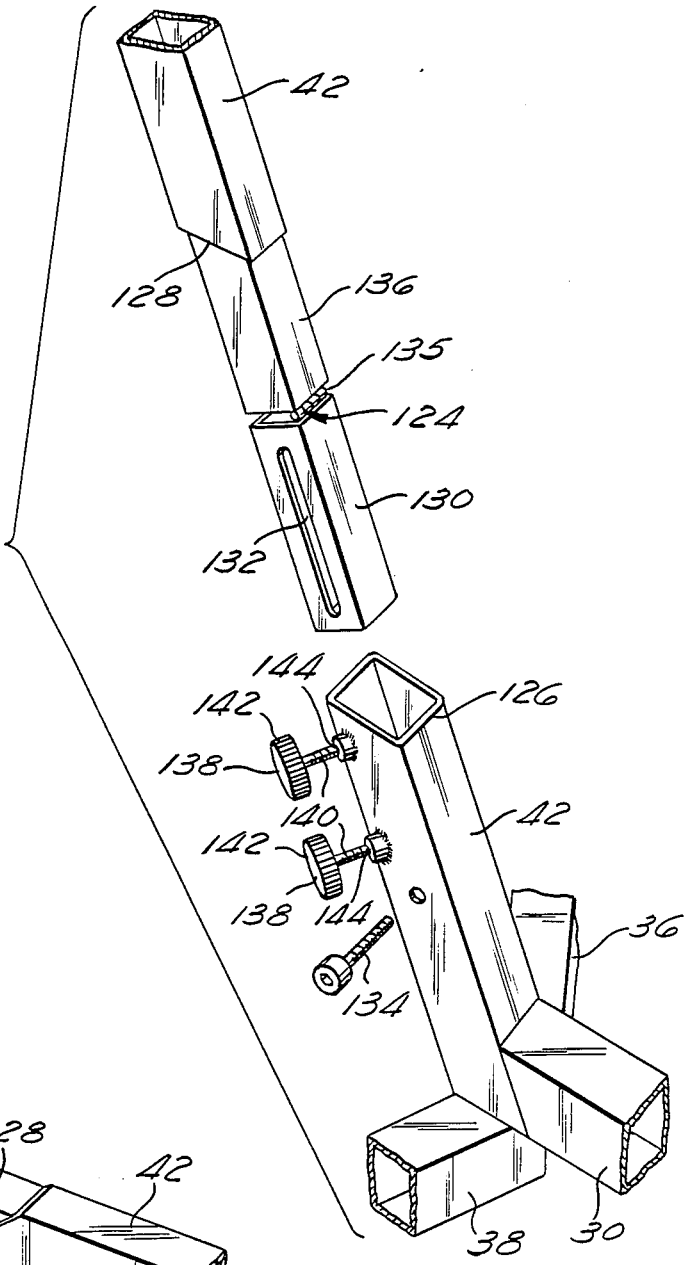
FIG. 5 is an exploded perspective of a slideable hinge used on the front fork tube.

Referring to FIG. 1, there is shown a portion of a multi-speed bicycle having a frame 10 with a rear axle 12 on which is mounted a rear wheel 14 and a rear tire 16. The frame 10 also contains a bottom bracket 18 to which a crank set and pair of pedals 20 are rotatably mounted. A seat 22, handlebars 24 and a rotatably mounted fork 26, are also connected to the frame 10 in a manner known in the art and not described in detail herein.

Referring to FIGS. 1 and 2, a portion of the bicycle is connected to a means for supporting the bike, such as support frame 28. The support frame 28 comprises a bottom member 30 which is approximately 27 inches long, and of a square tubular metal, approximately 1.5 inches per side, with a wall thickness of 0.109 inches.

At one end of the bottom member 30 are two rear legs 32 and 34 (FIG. 9) which extend in opposite directions generally perpendicular to the longitudinal axis of bottom member 30. Preferably, the legs 32 and 34 are opposite ends of a continuous member. At the opposite end of bottom member 30, there are connected two front legs 36 and 38 which extend in generally opposing directions from the bottom member 30. The front legs 36 and 38 extend at an angle of approximately 67° from the longitudinal axis of the bottom member 30 so as to angle away from the rear legs 32 and 34. The same angle, measured from the perpendicular, is 23°. The legs 32 and 34 are all of tubular metal construction having a generally rectangular cross-section approximately 0.75 inch×1.5 inches, with a wall thickness of about 0.120 inches. The legs 36 and 38 are also tubular of construction having a rectangular cross section of about 1 inch×2 inches, and a wall thickness of 0.120 inches.

The bottom member 30 and legs 32, 34, 36 and 38 lie generally in a plane so as to provide a stable support for the bike frame 10 and rider. Support feet 40 are located at the outermost ends of the legs 32–38 and are intended to rest against a floor.

A means for supporting and mounting the front fork 26 of a bicycle is provided which simulates the movement, and flexibility of a front wheel of a bicycle. Thus, fork tube 42 is connected to the juncture of bottom member 30 and front legs 36 and 38. The fork tube 42 extends out of the plane of the legs 32–38 at an angle of approximately 53° from that plane, and in a direction away from the rear legs 32 and 34. The fork tube 42 also extends along a plane passing through the longitudinal axis of the bottom member 30 and oriented substantially perpendicular to the plane formed by the legs 32–38. The fork tube 42 is of a tubular metal construction, using 1.5-inch square tubing with a wall thickness of 0.109 inch.

Figure 7:
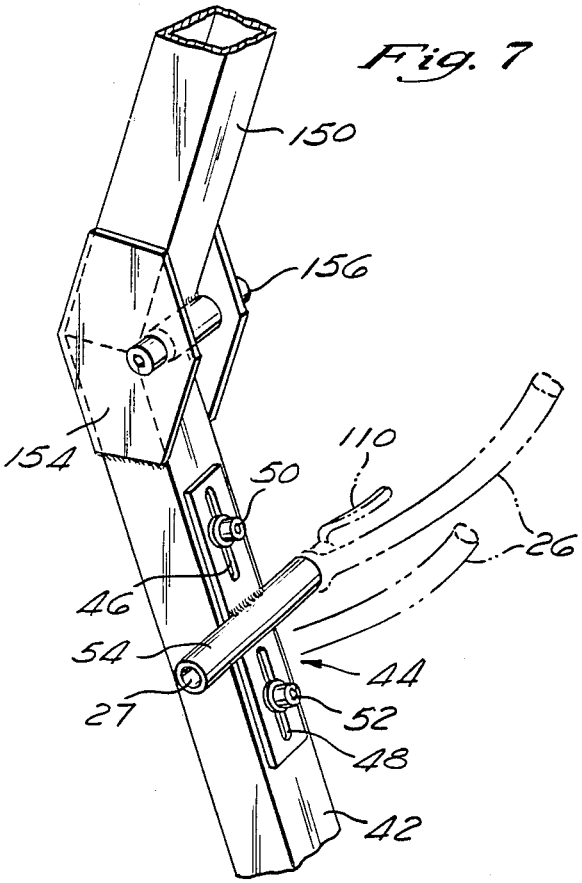
FIG. 7 is a perspective view of the front fork mounting structure and an adjacent hinge.

Referring to FIGS. 2 and 7, a fork mount 44 is connected to the side of the fork tube 42 facing the rear legs 32–34. Referring to FIG. 7, the fork mount 44 comprises a generally rectangular strip of metal 1.25 inches wide by 6.25 inches long and 0.135 inch thick. Two elongated slots 46 and 48 are located along the longitudinal axis of fork mount 44. Preferably, the slots 46 and 48 are approximately 0.34 inch wide by 1.85 inches long, and begin about 0.33 inch from the ends of fork mount 44.

Removable fasteners 50 and 52 extend through the slots 46 and 48 into corresponding apertures (not shown) in the fork tube 42 in order to connect the fork mount 44 to the fork tube 42. Preferably, the fasteners 50 and 52 take the form of threaded bolts. By loosening the fasteners 50 and 52, the slots 46 and 48 allow the fork mount 44 to be slid along the length of the slots 46 and 48, thereby permitting repositioning of the fork mount 44 relative to the length of the fork tube 42. The fasteners 50 and 52 can be removed so the fork mount 44 can be rotated 180° in the plane in which it is mounted, and then resecured. The fasteners 50 and 52 allow the fork mount 44 to flex, and help simulate a realistic movement of a bicycle attached to the frame 28 via the fork mount 44.

A fork mounting tube 54 (see also FIGS. 1 and 2) is connected to the fork mount 44. The fork mounting tube 54 comprises a metal tube approximately 3.5 inches long, with an outer diameter of about 0.75 inch, and an inner diameter of about 0.38 inch. The interior ends of the fork mounting tube 54 can be threaded. The fork mounting tube 54 is located with its longitudinal axis perpendicular to the longitudinal axis of the fork mount 44 and the slots 46 and 48. The fork mounting tube 54 is not located at the center of fork mount 44, but is offset approximately ¼-inch so that it is closer to the end of slot 48 than it is to the end of slot 46.

The fork mount 44 provides an adjustable attachment means for connecting the front fork of a bike to the fork tube 42. The adjustable feature is used to accommodate different sizes of bicycle frames and, as described later, to alter the elevation of the bike frame 10 by repositioning the fork mount 44 on the fork tube 42.

Referring to FIGS. 2 and 3, connected to the rear leg 32 is an inner support plate 56 and an outer support plate 58. The support plates 56 and 58 are substantially parallel plates located in planes substantially parallel to a plane passing through the longitudinal axis of bottom member 30, but substantially perpendicular to the plane in which the legs 32, 34, 36 and 38 are located. The inner support plate 56 is closer to the bottom member 30 than is outer plate 58. The support plates 56 and 58 can be made out of 0.134 inch thick steel.

An inner support plate 60, which generally corresponds to inner support plate 56, is connected in an analogous manner and orientation to rear leg 34. Similarly, an outer support plate 62, which corresponds to outer support plate 58, is connected in an analogous manner and orientation to the rear leg 34.

When a rear wheel 14 and rear tire 16 (FIG. 1) are connected to the apparatus, the rear tire 16 is constrained to move in a predetermined manner. Preferably, a rear axle support member constrains the rear axle 12 of a bicycle to move along a predetermined path. While the support member could be a U-shaped member, but preferably, the support member is a pair of axle tubes 64 and 66. The first axle tube 64 is rotatably mounted between the support plates 56 and 58, and a second axle tube 66 is rotatably mounted between the support plates 60 and 62. The first and second axle tubes 64 and 66 are constructed and connected in an analogous manner, so only the first axle tube 64 will be described in detail.

Referring to FIG. 3, the first axle tube 64 is preferably a stiff or rigid member, which does not flex to any great extent, and can comprise a tubular metal bar having a rectangular cross-section approximately 0.75 inch thick and 1.5 inches wide, 12.5 inches long and about 0.12 inch thick. A rotatable mount 68 is connected at one end of first axle tube 64 to one of the 1.5-inch wide sides of axle tube 64. The rotatable mount 68 is shown as a cylindrical tube with an outside diameter of about 1 inch and an inside diameter of about 0.52 inch, and a length of about 4.7 inches which corresponds to the spacing between the support plates 56 and 58. The longitudinal axis of the rotatable mount 68 is perpendicular to the longitudinal axis of the first axle tube 64.

The first axle tube 64 is mounted so that it can pivot in a plane substantially perpendicular to the plane in which the legs 32–38 are located, substantially parallel to the plane of the bottom member 30. This pivot axis is substantially parallel to the rotational axis of the rear wheel 14 and tire 16 connected to the axle tubes 64 and 66.

Pivoting action is achieved by passing a bolt 70 through a hole 72 in the outer support plate 58, through the inside of the rotatable mount 68, and through a corresponding hole (not shown) in inner support plate 56. A fastener 74, such as a threaded nut, is welded to the side of inner support plate 56 so that a threaded end on bolt 70 can be secured by the fastener 74 to prevent inadvertent removal of the bolt 70. The longitudinal axis of the bolt 70 is substantially parallel to the longitudinal axes of rear legs 32 and 34. The bolt 70 thus supports the first axle tube 64 and constrains the axle tube 64 to pivot about the longitudinal axis of bolt 70.

As previously stated, a second axle tube 66 is pivotally mounted and constrained to pivot about a bolt 70 in a similar manner as the first axle tube 64 with such bolts coaxially aligned. The axle tubes 64 and 66 are located adjacent the respective outer support plates 58 and 62. The inner sides of axle tubes 64 and 66 are about 11 inches apart. The first and second axle tubes 64 and 66 thus form movable support means which constrain the rear wheel 14 and tire 16 to move along a predetermined path.

As shown in FIGS. 2 and 3, at the end of axle tubes 64 and 66 opposite the pivotally constrained end are axle clamps 76 and 106 which are connected to the axle tubes 64 and 66 by an axle clamp bracket 78. Referring to FIG. 4, the axle clamp 76 comprises a metal cylinder with a conical depression 77 in one end. A pair of opposing rectangular slots 79 extend partway down opposing sides of the axle clamp 76. In use, a conicalshaped nut or end of the bicycle's rear axle 12 is seated in the conical cavity 77. The slots 79 accommodate D-rings that are used on the quick release skewers used with several bicycle models.

Referring to FIG. 3, the axle clamp bracket 78 comprises a repositionable support plate 80 comprised of a strip of metal having an L-shaped cross-section 0.75 inch on the short side, 1.5 inches on the long side, 6 inches long and 0.120 inches thick. An elongated slot 82 runs along the longitudinal axis of the plate 80 for a length of about 3 inches.

A bolt 84 has a threaded portion which extends through the slot 82 and through a hole (not shown) in axle tube 64. A fastener such as a threaded nut 86 can be removably connected with the threaded end of bolt 84 in order to releasably clamp the plate 80 to the axle tube 64. The plate 80 can be repositioned along the length of the axle tube 64 by loosening the bolt 84 and sliding the plate 80 along the length of slot 82, and then reclamping the bolt 84 and nut 86.

At the end of the plate 80, adjacent the unconstrained end of axle tube 64, is a clamp tube 88. The clamp tube 88 is a cylindrical tube having an outer diameter of about $\frac{7}{8}$ inch, a threaded inside diameter of about $\frac{1}{2}$ inch, and a length of about 1.5 inches. The tube 88 has its longitudinal axis substantially perpendicular to the longitudinal axis of axle tube 64 and substantially parallel to the longitudinal axis of bolt 70. A threaded shaft 90 threadingly engages the interior threads of tube 88. The axle clamp 76 is fastened at one end of shaft 90, with a knob 92 being fixed at the opposing end of shaft 90. By rotating the knob 92, the shaft 90 can be rotated so as to reposition the axle clamp 76.

A locking knob 93 is located intermediate to the knob 92 and the tube 88. The locking knob 93 is a knob having a threaded hole through the center, so the knob can be screwed along the length of threaded shaft 90. When the axle clamp 76 is correctly positioned, the locking knob 93 is screwed against the end of tube 88 to provide a frictional lock, preventing axial movement of shaft 90 and axle clamp 76.

A second axle clamp 106 coaxially aligned with clamp 76 (FIGS. 3 and 4) is connected to the unconstrained end of the second axle tube 66 in the same manner as axle clamp 76 is connected to the first axle tube 64. Thus, the details of the second axle clamp 106 and its supporting bracket will not be repeated, other than to note that one axle clamp is slightly longer, with a deeper slot 79, in order to accommodate a variety of designs for axles 12 as used on diverse bicycles.

Referring to FIGS. 2 and 3, a rotatable means helps support the rear wheel 14 of a bicycle connected to the apparatus of this invention. A roller 108 is rotatably supported between the inner support plates 56 and 60. Preferably, the roller 108 is a cylindrical roller with a width of about 2.6 inches and an outer diameter of 2.5 inches, made of aluminum. The roller 108 is rotatably mounted so that its longitudinal axis is substantially parallel with the longitudinal axis of bolt 70 and the pivot axis of first and second axle tubes 76 and 106, and with the rotational axis of a rear wheel 14 connected to the apparatus.

Referring to FIG. 1, preferably the support frame 28 connects to, and supports, the bike frame 10 at three locations. As shown best in FIG. 7, the fork 26 of bike frame 10 can be removably connected to the fork mount 44 by use of a quick-release skewer 110. The quick-release skewer 110 is commonly used on bicycles having a readily removable front wheel, and thus is known in the art and will not be described in detail. The ends of fork 26 fit over the fork mounting tube 54. The quick-release skewer 110 is inserted through the fork 26 and the fork mounting tube 54, and then locked to secure the fork 26 to the fork mount 44. Basically, the fork mount 44 is connected just as if it were the front wheel of a bike.

Referring to FIG. 1, the rear axle 12 of the bike frame 10 is supported by the first and second axle clamps 76 and 106. The conical apertures 77 (FIG. 4) in the axle clamps 76 and 106 fit over the opposite ends of the rear axle 12 so as to support axle 12 and bike frame 10. The rear axle 12 is constrained to move along an arcuate path about the rotational axes of first and second axle tubes 64 and 66, with the path being generally toward roller 108.

The tire 16 rests against the roller 108. Preferably, when viewed in a horizontal plane, the roller 108 is in front of the rear axle 12. The rear axle 12 is shown as being horizontally in front of the rotational axis about which the axle tubes 64 and 66 rotate. Thus, the axle 12 (about which rear wheel 14 rotates) is positioned, relative to a horizontal plane, between the roller 108 and the rotational axis about which axle tubes 64 and 66 rotate. Alternately phrased, if substantially parallel vertical planes are passed through the rear axle 12, rotational axis of roller 108, and the rotational axes of axle tubes 64 and 66, then the vertical plane containing the rear axle 12 lies between the planes containing the rotational axes of roller 108 and axle tubes 64 and 66. Phrased yet another way, a substantially vertical plane through the rear axle 12, would result in the pivot axis of the rear axle tubes 64 and 66 and the roller 108, being located on opposite sides of that vertical plane.

It is believed preferable that the angle of the rear axle tubes 64 and 66, with respect to the vertical, be between 5°–30°. From this position, the tubes 64 and 66 will rotate from 1°–4° further during operation, depending on rider weight and strength, tire pressure, and the specific bike frame 10. When the bike frame 10 is that of a Specialized Allez, having a 52 cm frame, and a 99 cm wheelbase, with 700C wheels, the angle is about 26.5°, with the rear axle 12 being about 10.5 inches from the pivot points of axle tubes 64 and 66, and with the rear axle 12 being almost vertically above the rotational axis of roller 108. These dimensions are at the extreme end of dimensions for a short wheelbase racing bicycle.

If the axle 12 is positioned vertically above, or in front of (i.e. toward the handlebars 24) the roller 108, the invention will still function, but as the axle 12 is moved in front of the roller 108, then the performance is increasingly degraded, but can it function, if the rear axle 12 is positioned vertically above, or behind the pivot axis of bolts 70, the rear tire 16 will not be constrained to move into contact with the roller 108 and the apparatus will not satisfactorily function. The objective is to cause the rear tire 16 to move into contact with the roller 108 when the torque on the tire 16 increases, as when the rider leaves the saddle 22 and leans over the handlebars 26 to exert maximum force on the pedals 20.

Preferably, the rotational axis of roller 108 is about 4.6 inches (horizontally) from the rotational axis of axle tubes 64 and 66, and about 5.1 inches (vertically) from the rotational axis of axle tubes 64 and 66.

The fork mount 44, the axle clamps 76 and 106 (FIG. 2), and the roller 108 provide a three-point support for the bike frame 10 when the frame 10 is coupled to the support apparatus. As a rider pedals the bike via pedals 20, the rear wheel 14 and tire 16 frictionally engage the roller 108, causing roller 108 to rotate.

It is believed possible, although not preferred, to have only the axle clamps 76 and 106 support the bike frame 10, in which case the front fork tube 52 would be eliminated, and the bottom member 30 shortened, so a standard front wheel of a bicycle could be used to support the front fork 26. It is also believed possible, but not preferred, to support the front fork tube 42 separately from the remainder of the frame 28, and to adjust the flexibility of the fork tube 42 to simulate the stiffness, and to allow the movement, of a normal front wheel of a bicycle.

Referring to FIGS. 2 and 3, a variable load device, such as an electromagnetic apparatus like an alternator 112, powered by 110 V AC, is connected to the roller 108. The alternator 112 is connected to the inside support plate 56 and is located between support plates 56 and 58. An alternator shaft 114 (FIG. 3) extends through a hole in the inner support plate 56 (FIG. 2). One end of the alternator shaft 114 (FIG. 3) is connected to the alternator 112, with the opposing end being connected to the roller 108, preferably by shrink-fitting the roller 108 onto the end of the alternator shaft 114.

By applying a variable amount of electrical power to the alternator 112, a variable and controllable amount of resistance can be applied to the roller 108, and thus to the tire 16 and the pedals 20 (FIG. 1). This variable load resistance can be used to simulate the resistance experienced by pedalling on different grades, downhill, flat or uphill. The load can simulate rolling resistance, wind resistance, terrain variations, and if properly programmed, can even simulate the inertia of the bicycle and rider. Thus, the alternator 112 communicates with the roller 108 to simulate a realistic bicycle ride.

Preferably, the inertia is simulated by inertia means, such as a flywheel 116, which is rotatably mounted between the support plates 60 and 62 (FIG. 2). The rotational axis of flywheel 116 coincides with the rotational axis of roller 108 and alternator 112. A specific flywheel could be designed for a given weight of a bicycle and rider, and a maximum speed. Space, safety and weight constraints must also be considered, however. A flywheel 116 found suitable for use is designed to rotate at a maximum speed of about 5000 rpm, for an equivalent bike speed of 40 miles per hour. Such a flywheel weighs about 22 pounds, and when made of cast iron, can take the form of a rimmed circular disc 2 inches wide and 8 inches in diameter. The inertia of such a usable flywheel has been calculated to be 0.0416 ft-lb-sec$^2$.

The flywheel 116 communicates with roller 108 so rotation of the roller 108 rotates the flywheel 116. As shown, the flywheel 116 is mounted on a shaft 118 which extends through a hole in the inner support plate 60 to connect to the roller 108. Preferably, the roller 108 is shrink-fit onto one end of the flywheel shaft 118. Thus, the flywheel 116, roller 108 and alternator 112 are essentially on a common rotational shaft. The inertia means, such as flywheel 116, simulates the inertia of a moving bicycle and rider.

Figure 6:
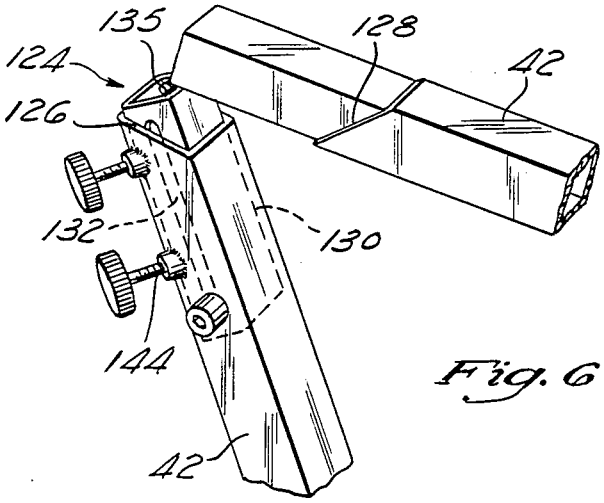
FIG. 6 is a perspective view of the assembled hinge shown in FIG. 5.

Referring to FIGS. 1 and 2, the fork tube 42 is about 21.5 inches long, and contains a hinged joint 124 which is best shown with reference to FIGS. 5 and 6. At a point approximately 7.5 inches above the plane of the legs 32–38 (FIG. 1), the fork tube 42 is cut at an angle such that there is a first end 126 and second end 128 which can be releasably placed in an abutting configuration. On the inside of fork tube 42 adjacent the first end 126, there is inserted a smaller, slidable tubular section 130 which is configured to just fit inside of the first end 126. On opposing sides of slidable tubular section 130 are located longitudinal slots 132. A fastener such as bolt 134 extends through opposing sides of fork tube 42 and through the slots 132 so as to captivate the slidable tubular section 130. Thus, the slidable tubular section 130 can be moved along the longitudinal axis of the fork tube 42 until the bolt 134 bottoms out against the ends of the slots 132.

A rotatable hinge 135 rotatably connects slidable tubular section 130, with a correspondingly sized tubular section 136. The tubular section 136 fits inside of, and is securely fastened to, the second end 128 of fork tube 42.

Figure 8:
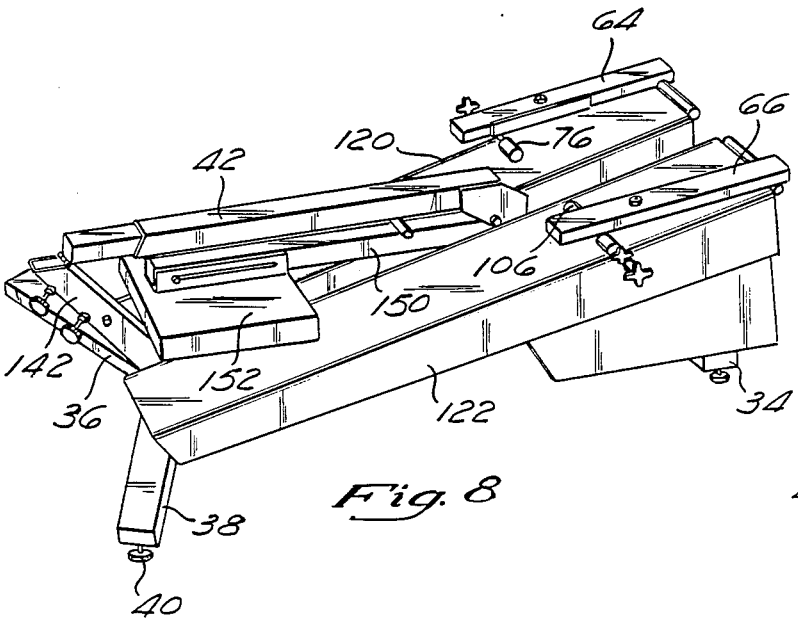
FIG. 8 is a perspective view of the invention with its support members folded into adjacent relationship to form a more compact, portable structure.
Figure 10:
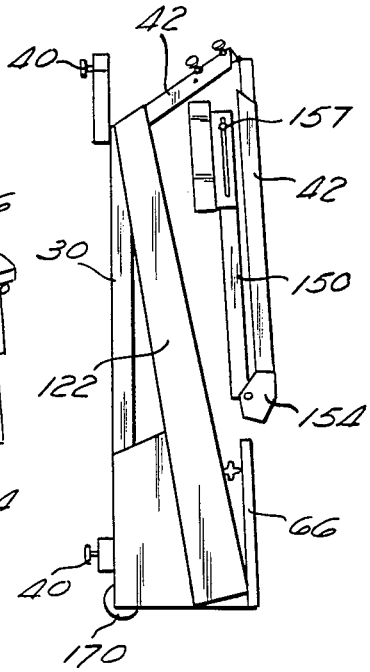
FIG. 10 is a side view of the folded and collapsed structure of FIG. 8.

In operation, the tubular sections 130 and 136 fit on the inside of fork tube 42 and provide a structurally strong joint when the ends 126 and 128 are abutting. The sections 130 and 136 allow the first and second ends 126 and 128 to be separated by a force exerted along the longitudinal axis of fork tube 42. When the first and second ends 126 and 128 are separated, the hinge 135 allows the portion of the fork tube 42 containing the end 128 to be folded so as to collapse the support frame 28 into a more compact configuration (FIGS. 8, 10).

In order to ensure the integrity of the hinged joint 124 in the uncollapsed position, and to prevent inadvertent separation of the hinged joint 124, releasable fasteners 138 (FIG. 5) extend through the side walls of fork tube 42 and releasably fasten the slidable tubular section 130 into secure position. The fasteners 138 each comprise a threaded portion 140 extending from a knob 142. Each threaded portion 140 extends through an associated threaded aperture 144 in fork tube 42 so that the end of the threaded portion comes into contact with and binds against the slidable tubular section 130 so as to prevent movement of such sections within tube 42. The apertures 144 preferably are located in the corner of the fork tube 42.

The hinged joint 124, and the rotation of the axle tubes 64 and 66 (FIGS. 8, 10), thus provide collapsible joints by which a stable operational structure can be formed, but which can be collapsed or reconfigured to a configuration more suitable for storage or portability.

Referring to FIG. 1, a side cover 120 has one end connected to the support plates 56 (FIG. 2) and 58 with the opposing end connected to the front leg 36. A corresponding side plate 122 is connected between support plates 60 and 62 (FIG. 2), and front leg 38. The side covers 120 and 122 cover the flywheel 116 and alternator 112 (FIG. 2), and provide some stiffness and stability to the support frame 28 as well. Because the support plates 56–62 (FIG. 2) are higher than the front legs 36 and 38, the side covers 120 and 122 slant downward at an angle. The side covers 120 and 122 must be sufficiently low so that a rider's heel will not hit the side plates when pedalling. In a similar manner, the axle tubes 64 and 66 must not be so long that they will be hit by the heel of a rider when pedalling.

The side plates 120 and 122 are removable (see FIG. 2) and comprise generally C-shaped structures preferably made out of sheet metal having a thickness of about 0.060 inches. The sides of the side plates 120 fit over the sides of the support plates 56 and 58 (FIG. 2), and the sides of the side plate 122 fit over the sides of the support plates 60 and 62 (FIG. 2). The sides plates 120 and 122 are spaced apart so that the bottom member 30 is visible between the side plates 120 and 122.

Referring to FIGS. 1 and 2, a display tube 150 is connected to the upper end of fork tube 42. A display 152 is in turn connected to the outer end of display tube 150. The display tube 150 is of the same general construction as fork tube 42, and is rotatably joined to fork tube 42 by rotatable joint 154. The joint 154 comprises a hinged member which uses one or more frictionally releasable devices to hold the joint stable when desired, or to release the joint to allow a rotation when desired. The releasable frictional device is shown as comprising a hinged joint, having a side through which a threaded fastener 156 extends to releasably lock the joint 154 by loosening or tightening the fastener 156, the friction in the joint 154 is increased or decreased, so as to lock the joint 154 into position or to allow it to rotate.

The end of display tube 150 is connected to display 152 by means of a repositionable and tiltable joint 157. A channel bracket 159, having a C-shaped cross section is fastened to the back side of the display 152, with the free legs of the C-section extending outward from the display 152. Each of the free legs of channel bracket 159 has a slot 160, running along the length of the bracket 150. The display tube 150 fits within the channel bracket 159. A releasable fastener 162 has a shaft (not shown) that passes through slots 160 and through a hole (not shown) adjacent the outer end of display tube 150, and connects to a threaded knob (not shown). The fastener 162 and threaded knob cooperate to frictionally lock the end of the display tube 150 to the bracket 159, and thus to the display 152. The connection is releasable by loosening the fastener 162.

The slots 162 allow the display 152 to be positioned relative to the end of the display tube 150, and effectively provide a means for adjusting the height of the display 152. The display 152 can also be rotated about a loosened fastener 162 to adjust the angular orientation of display 152, and tightening the fastener 162 locks the display into position. There is thus provided a joint 157 that allows repositioning and tilting of the display 152.

The display 152 is in electrical communication with the alternator 112 so that various loads can be controlled from, and displayed by, the display 152. The electrical communication mean can comprise wires, which are known in the art and not described in detail, or shown herein. Thus, for example, a rider can input the resistance which is desired to be exerted by the alternator 112, and can monitor the speed at which the bike is being pedalled against that predetermined resistance.

Referring to FIG. 1, the operation of the invention will now be described. A person can take his or her own personal bicycle, remove the front wheel and mount it to the support frame 28. Many modern racing bikes have removable front wheels which facilitate this installation. The fork 26 of the bike frame 10 is attached to the fork mount 44 by use of a quick-release skewer 110. To accommodate for different sizes of bike frames 10, the fork mount 44 can be releasably positioned by loosening fasteners 50 and 52 (FIG. 7), repositioning the fork mounting tube 54 and then refastening fasteners 50 and 52.

Referring to FIG. 7, as previously mentioned, the fork mounting tube 54 is asymmetrically located between the ends of the slots 46 and 48. By slidably positioning the fork mount 44, relative to the fork tube 42, it is possible to adjust the vertical elevation of the bike frame 10. Many riders find a slight uphill elevation to be more comfortable when riding a stationary bicycle.

Preferably the fasteners 50 and 52 are positioned at, and rest against the upper ends of the slots 46 and 48. If so positioned, the mount 44 bears against the fastener 50 and 52.

Since the mounting tube 54 is offset relative to the ends of slots 46 and 48, the mounting plate 44 can be rotated 180° in plane to change the elevation of the mounting tube 54 (and the bike 10), while still alllowing the fasteners 50 and 52 to bear against the ends of the slots 46 and 48.

Referring to FIGS. 1 and 3, the tire 16 is placed on the roller 108. The first and second axle tubes 64 are then rotated so the first and second axle clamps 76 and 106 can engage opposite ends of rear axle 12. Turning knobs 92 (FIG. 3) allows the axle clamps 76 and 106 (FIG. 3) to be adjusted along the length of rear axle 12 so the ends of axle 12 can seat in the conical apertures 77. The threaded shaft 90 (FIG. 3) therefore provides an adjustable means for accommodating different axle lengths for positioning of the bicycle frame 10 between the first and second axle tubes 64 and 66. The ability of the first and second axle tubes 64 and 66 to rotate combine with the ability to reposition the axle clamp bracket 78 (FIG. 3) to accommodate a wide range of bike sizes.

Referring to FIG. 1, in operation, the mounting of the fork 26 to the fork mount 44 provides a flexible mount that reduces stresses and fatigue failure problems with the fork 26. The flexibility is provided by the fact that the fork mount 44 can effectively pivot or flexibly rock about a line passing through the fasteners 50 and 52 (FIG. 7), even when those fasteners are tightly secured. The fork mount 44 and the fasteners 50 and 52 bend to allow this flexibility. The flexibility simulates the lateral flexibility of a front wheel of a bicycle to further simulate a realistic ride.

A rider can reposition the fork mount 44 to provide for a level orientation of bike frame 10, or a slightly elevated orientation as previously described. When the rider sits on the seat 22 and exerts force on the pedals 20, the weight of the bicycle and rider force the tire 16 against the roller 108 to provide a frictional drive of the roller 108. The flywheel 116 (FIG. 2) simulates the inertia of the rider and bicycle, while the variable resistance exerted by alternator 112 (FIG. 2) can be used to simulate a ride on a level surface, a downgrade, an uphill grade or any combination of variable grades.

In use, however, the rider does not always stay seated in the seat or saddle 22, but at times of maximum power, rises off of the saddle, leans over the handlebars 24 and exerts all of the rider's weight on the pedals 20. Thus, while more of the rider's weight is on the rear wheel when the rider is seated in the saddle 22, the rider's weight is shifted towards the front wheel when the rider rises out of the seat 22 and exerts maximum force and weight on the pedals 20.

As the weight of the rider shifts toward the fork 26, the frame 28 operates to maintain, and can actually increase the friction between the tire 16 and the roller 108 in order to prevent slippage. The first and second axle tubes 64 and 66 constrain the rear axle 12 to move along a predefined, arcuate path such that a shift in the weight of the rider toward the fork 26 causes the axle 12, and thus the tire 16, to move toward to the roller 108.

It is also believed that the relative stiffness between the bike frame 10 with respect to the frame 28 is such that a movement of the rider toward the fork 26 causes the fork tube 42 to bend or flex forward and downward and, since the bike frame 10 is connected to the fork tube 42, the bike frame 10 causes the constrained axle 12 to rotate toward the roller 108. It is believed preferable that the stiffness of the bike frame 10, including the fork 26, be greater than the stiffness of the support frame 30, which includes fork tube 42, and the axle tubes 64 and 66.

While the exact theoretical basis may not be precisely known, the practical effect is apparent. With the rider seated in the seat 22, the roller 108 and support axles 64 and 66 support the weight that is normally on the rear wheel so there is no excessive friction between the roller 108 and the rear tire 16. As the weight of the rider shifts forward from the seat 22 toward the fork 26, the tire 16 does not slip against the roller 108. The fork tube 42 and constrained rear axle 12 move in unison albeit perhaps in different amounts, with the amount of motion varying with the amount of force exerted on the pedals 20, and the position of the rider relative to the front fork 26. Further, a rider using toe clips and straps on the pedals 20, appears to exert a forward force on the pedals 20 which also causes the fork tube 42 and constrained rear axle 12, to move in unison.

Such was not the case with prior art devices using single or double support rollers. For example, many prior devices used a support that connected to the bottom bracket 18 (FIG. 1). As the weight of the rider shifted forward, the bike pivoted about the support connected to the bottom bracket 18, and the tire 16 moved out of contact with the prior art roller(s). Further, the mere shift in the rider's weight decreased the force on the rear wheel, and thus decreased the friction against the rollers. Thus, the shift of the weight of the rider effectively decreased the friction between the tire and the roller, causing the roller to slip just when the maximum amount of power was being transferred to the tire.

There is thus advantageously provided a means of increasing the friction between the tire 16 and the roller 108 during periods when the maximum power is being applied to the pedals 20. There is thus also advantageously provided a means of using the location of the weight of the rider to prevent slippage between the tire 16 and the roller 108. There is also provided a means of using the flexibility of the frame 28 to prevent slippage and increase the friction between the tire 16 and roller 108.

Referring to FIGS. 8 and 10, a further advantage of the present invention is that collapsible means are provided so the apparatus can be folded into a compact package to make it readily portable. As previously described, the first and second axle tubes are rotatable about the axis running along the length of bolt 70 (FIG. 3). By correctly positioning the rotational joint, the first and second axle tubes 64 and 66 can be folded into a more compact shape. Preferably, they can be folded adjacent the side covers 120 and 122.

The joints 124, 154 and 157 allow the display 152 to be folded adjacent the side covers 120 and 122. The fork tube 42 and the display tube 150 can fit into the space between the side covers 120 and 122. There is thus provided collapsible means which allow the apparatus to be folded into a more copact, portable configuration than the operational configuration of the apparatus.

Figure 9:
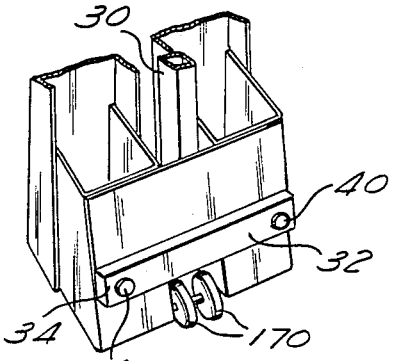
FIG. 9 is a perspective view of a segment of the invention showing wheels on the structure.

Referring to FIG. 2, the heaviest portion of the invention is located at the support plates 56, 58, 60 and 62, which support the flywheel 116 and the alternator 112. Referring to FIG. 9, to increase the ease of portability, a pair of rotatable wheels 170 are mounted at the juncture of the rear legs 32 and 34, opposite the joinder of the bottom member 30. When the invention is lifted so as to rotate about a line passing through the rear legs 32 and 34, the wheels 170 come in contact with the ground or floor so that the invention can be rolled without dragging the footpads 40. The wheels 170 are not able to roll when the apparatus is in its operational position as shown in FIGS. 1 and 2.

Referring to FIGS. 8–10, preferably, the back surface of the covers 120 and 122 and the support plates 56–62 (FIG. 2) are flat so that the invention can maintain a stable standing position on its end, in a vertical orientation as illustrated in FIGS. 9 and 10.

There is thus provided a compact, portable device which, when combined with a bicycle, provides an exercise bicycle with a realistic simulation of a ride.

We claim:

1. An exercise device which realistically simulates the pedal resistance, body position and feel of riding a bicycle, including maximum performance periods when the user is not sitting on the saddle but is instead leaning over the front handlebars and essentially standing on the pedals, comprising:

a stationary frame for mounting components of a bicycle, said bicycle including a rear wheel, a rear tire and a rear axle, a frame, a seat, a front fork, handlebars and pedals, wherein said stationary frame comprises:

rear axle support means for connecting to opposite ends of said rear axle without preventing rotation of said rear wheel and tire, said rear axle support means constraining said rear axle, wheel and tire to move along a predetermined path; and fork support means for connecting to and supporting said front fork, said fork support means being movable in response to a shift in the weight of a rider; and a roller mounted to said frame so as to frictionally engage said rear tire of the bicycle when said rear axle is connected to said rear axle support means, said rear axle support means constraining said rear axle to move along said path toward said roller during exercise use of the device, said roller and said rear axle support means cooperating to support said rear wheel and tire when said rear axle is connected to said rear axle support means so as to maintain frictional contact between said roller and said rear tire whose axle is connected to said rear support means, as the weight of a rider is shifted toward said fork support means, so as to prevent slippage between said roller and said rear tire.

2. An exercise device as defined in claim 1, wherein said rear axle support means comprises at least one rotatable member constrained to rotate about an axis substantially parallel to the rotational axis of a rear wheel of the bicycle when said wheel is connected to said rear axle support means.

3. An exercise device as defined in claim 2, wherein said rotational axis of said rear axle support means and the rotational axis of said roller are located on opposite sides of a substantially vertical plane through a rear axle of a bicycle connected to said rear axle support means.

4. An exercise device as defined in claim 1, further comprising:

flywheel means communicating with said roller to simulate the momentum a rider and bicycle achieve during actual riding of a bicycle; and variable load-applying means communicating with said roller for applying variable loads to said roller to simulate variations in the load encountered during actual riding of a bicycle.

5. An exercise device as defined in claim 3, further comprising:

flywheel means communicating with said roller to simulate the momentum a rider and bicycle achieve during actual riding of a bicycle; and variable load-applying means communicating with said roller for applying variable loads to said roller to simulate variations in the load encountered during actual riding of a bicycle.

6. An exercise device as defined in claim 1, wherein said stationary frame further comprises collapsible means for compacting said stationary frame into a smaller, portable configuration.

7. An exercise device as defined in claim 4, wherein said stationary frame further comprises collapsible means for compacting said stationary frame into a smaller, portable configuration.

8. An exercise device as defined in claim 5, wherein said stationary frame further comprises collapsible means for compacting said stationary frame into a smaller, portable configuration.

9. An exercise device as defined in claim 1, wherein said predetermined path is arcuate.

10. An apparatus, comprising:

a frame;

a roller rotatably mounted to said frame to rotate about a first axis;

a rear axle support member pivotally mounted to said frame to rotate about a second axis substantially parallel to said first axis;

axle clamp means on said rear axle support member for supporting opposing ends of a rear axle of a bicycle, said axle clamp means cooperating with said rear axle support member to constrain said rear axle when mounted in said axle clamp means so that during exercise use of said bicycle said axle is caused to rotate toward said roller along a predetermined path defined by the rotation of said rear axle support member; and variable load-applying means communicating with said roller for supplying variable forces to said roller to simulate the variations in load encountered during actual riding of a bicycle when said rear wheel of said bicycle is frictionally engaged with said roller and has a rear axle supported by said support member.

11. An apparatus as defined in claim 10, further comprising flywheel means communicating with said roller for energy storage during rotation of said roller by frictional engagement with a rear wheel of a bicycle when said bicycle has a rear axle supported by said support member, said flywheel means simulating the momentum of a bicycle and rider during actual riding of a bicycle.

12. An apparatus as defined in claim 10, further comprising:

a front fork support connected to said frame; and fork mounting means on said front fork support adapted to connect a front fork of a bicycle to said front fork support, said front fork support being connected to said frame such that movement of said front fork support cooperates with said axle support member to maintain friction contact between said roller and a rear tire mounted to a bicycle wheel having a rear axle supported by said axle support member.

13. An apparatus as defined in claim 12, wherein said fork mounting means is adjustable to change the elevation of a bicycle frame having a front fork connected to said mounting means.

14. An apparatus as defined in claim 12, further comprising joint means on said front fork support and said rear axle support member for positioning said front axle support and said rear axle support member in adjacent relationship to said frame to form a smaller, portable configuration of said apparatus.

15. An apparatus as defined in claim 10, wherein said first and second axes are located on opposite sides of a substantially vertical plane through a rear bicycle axle mounted to said axle clamp means.

16. An apparatus as defined in claim 15, wherein said rear axle support member is inclined at an angle of between 5–30 degrees with respect to a vertical axis.

* * * * *